United States Patent [19]

Makishima

[11] Patent Number: 4,931,123

[45] Date of Patent: Jun. 5, 1990

[54] HEAT-SENSITIVE COLOR TRANSFER RECORDING MEDIUM

[75] Inventor: Hideo Makishima, Tokyo, Japan

[73] Assignee: Mitsubishi Paper Mills, Ltd., Tokyo, Japan

[21] Appl. No.: 145,097

[22] Filed: Jan. 19, 1988

[30] Foreign Application Priority Data

Jan. 23, 1987 [JP] Japan ..... 62-14930

[51] Int. Cl.[5] ..... B41M 5/26

[52] U.S. Cl. ..... 156/234; 156/235; 156/237; 156/238; 156/277; 427/265; 428/195; 428/484; 428/488.1; 428/913; 428/914

[58] Field of Search ..... 428/195, 484, 488.1, 428/488.4, 913, 914; 156/234, 235, 237–240, 277; 427/265

[56] References Cited

U.S. PATENT DOCUMENTS 4,503,095 3/1985 Seto et al. ..... 428/488.1
4,588,315 5/1986 Seto et al. ..... 427/265

FOREIGN PATENT DOCUMENTS 1376688 7/1985 Japan ..... 428/913

*Primary Examiner*—Pamela R. Schwartz
*Attorney, Agent, or Firm*—Cushman, Darby & Cushman

[57] ABSTRACT

A heat-sensitive color transfer recording medium having a yellow hot-melt ink layer comprising 81 to 92% by weight of a solid wax, 2 to 13% by weight of a resin and a balance of a yellow pigment, can provide clear full color images without causing badness in transfer of a yellow color at initial printing, particularly at low temperature transfer.

7 Claims, No Drawings

HEAT-SENSITIVE COLOR TRANSFER RECORDING MEDIUM

BACKGROUND OF THE INVENTION

This invention relates to a heat-sensitive color transfer recording medium which is suitably used in thermal recording apparatus such as thermal transfer color printers, etc.

Recently, the thermal transfer color printers have passed beyond its purely academic and developmental stage to a practical stage and are coming into wide use rapidly. The thermal transfer color printers are used as color printers for computer aided design (CAD), computer aided manufacturing (CAM), and as color printers for full color copy machines.

Heat-sensitive color transfer recording mediums used in these thermal transfer color printers are composed of a substrate and a hot-melt ink layer.

As the substrate, a polyethylene terephthalate (PET) film of about 4 to about 7 μm in thickness is suitably used. Usually, its surface to be brought into contact with a thermal head is provided with a heat-resistant layer to prevent sticking (fusing to the thermal head).

Hot-melt inks are usually applied onto the substrate sequentially in the order of yellow, magenta and cyan or in the order of yellow, magenta, cyan and black, and the heat-sensitive color transfer recording medium is used in roll form after being rolled round a cardboard core. Usually, the hot-melt inks are transferred in the order of yellow, magenta, cyan and black. The black hot-melt ink is used not only for transfer but also for a sensor.

The hot-melt inks are heated to the melting point or above by a very low applied energy from a thermal head to undergo phase change from solid to liquid, and transferred onto an image-receiving sheet to form images.

The hot-melt inks comprise coloring agents, solid waxes, resins, etc., and the blending proportions of these components greatly affect the transferability, the adherence to the substrate, the preservation at high temperatures (e.g. antiblocking) and the like, soiling of rollers in a printer, etc.

Whether the heat-sensitive color transfer recording medium can be used in a thermal transfer color printer or not is determined by a slight change of the blending proportions. For suitable employment of the heat-sensitive color transfer recording medium, its matching with a thermal transfer color printer is very important in practice.

For example, in U.S. Pat. No. 4,503,095, there is proposed a composition comprising 1 to 20% by weight of a coloring agent, 20 to 80% by weight of a binder (a solid wax) and 3 to 25% by weight of a softening agent (a resin or a lubricating oil). When a lubricating oil is incorporated into hot-melt ink, the ink is softened, so that rollers in a printer is solid and that printed images by transfer are liable to become dirty. Therefore, employment of no lubricating oil is preferred.

When a hot-melt ink containing 20 to 80% by weight of a solid wax is used as in the above-mentioned prior art reference, a yellow color as the first color tends to become blurred owing to badness in transfer at low temperatures (15° C. or lower) in the case of starting printing by means of a thermal transfer color printer in which an applied energy to a thermal head is low. The second color and the subsequent color(s) are less liable to undergo badness in transfer than the yellow color by virtue of heat left in the thermal head. In the case of the color thermal transfer printer, printed letters of the three or four colors are superimposed, so that printing of a receiving sheet of about A4 size requires about 1 minute. Since high-speed printing is one sailing point of the color thermal transfer printer, the applied energy to the thermal head cannot be made very high, and when a hot-melt ink containing 20 to 80% by weight of a solid wax is used, printed letters of the first color, i.e., yellow tend to become blurred owing to badness in transfer.

Therefore, the color thermal transfer printer is designed to increase the applied energy to the thermal head at initial printing but has been disadvantageous in that sticking is caused at initial printing and that temperature control of the printer is complicated.

SUMMARY OF THE INVENTION

An object of this invention is to solve these problems of prior art by improving a heat-sensitive color transfer recording medium.

This invention provides a heat-sensitive color transfer recording medium comprising a substrate and hot-melt inks of a plurality of different colors including yellow applied onto one side of the substrate, the yellow hot-melt ink for printed letters of the first color comprising 81 to 92% by weight of a solid wax, 2 to 13% by weight of a resin and a balance of a pigment.

DESCRIPTION OF THE PREFERRED EMBODIMENTS

Each hot-melt ink used in this invention comprises a coloring agent, a solid wax and a resin.

As the coloring agent, for example, the following can be used. As yellow coloring agent, there can be used Chromophthal Yellow 3G, Hansa Yellow G, Hansa Yellow 5G, Hansa Yellow RN, Hansa Yellow A, Hansa Yellow R, Lionol Yellow K-2R, Benzidine Yellow G, Benzidine Yellow GR, Quinoline Yellow Lake, etc.

As magenta coloring agents, there can be used Rhodamine Lake Y, Brilliant Carmine 6B, Brilliant Carmine BS, Permanent Carmine FB, Hosta Palm Pink, Brilliant Fast Scarlet, Permanent Red F5R, etc.

As cyan coloring agents, there can be used Phthalocyanine Blue, Lionol Blue, Victoria Blue Lake, Fast Sky Blue, etc.

As black coloring agents, there can be used carbon black, graphite, iron black, Aniline Black, etc.

As the solid wax, there can be used petroleum waxes such as paraffin wax, microcrystalline wax, etc.; vegetable waxes such as carnauba wax, candelilla wax, rice wax, etc.; synthetic waxes such as low-molecular-weight polyethylene wax, Montan wax, Fischer-Tropsch wax, etc.; oxidized waxes such as oxidized paraffin wax, oxidized polyethylene wax, etc.

It is preferable to use a solid wax having a melting point of 50° C. or higher (a peak temperature value measured by a differential scanning calorimeter (DSC)), more preferably 50 to 80° C., most preferably 65 to 75° C.

As the resin, there can be used thermoplastic resins such as ethylene-vinyl acetate copolymer, ethylene-ethyl acrylate copolymer, polyamide resins, rosin and rosin derivatives, terpene resins, petroleum resins, coumarone-indene resin, etc.

In the yellow hot-melt ink, the content of the solid wax is 81 to 92% by weight, preferably 82 to 92% by weight, more preferably 83 to 91% by weight, that of the resin is 2 to 13% by weight, preferably 2 to 12% by weight, and the balance is the content of the yellow pigment. By employment of the composition described above, badness in transfer of the yellow color at initial printing, particularly the badness in transfer at low temperatures can be prevented. The amount of yellow pigment is preferably 6% by weight or more, more preferably 6 to 9% by weight, considering the coloring ability.

The amount of resin in the yellow hot-melt ink is 2 to 13% by weight. When the amount is less than 2% by weight, the adhesiveness between the substrate and the hot-melt ink becomes poor so as to easily bring about peeling of the hot-melt ink undesirably. In order to prevent the peeling completely, the amount of 3% by weight or more is preferable. On the other hand, when the amount of resin is more than 13% by weight, there easily brings about badness in transfer at initial printing, particularly the badness in transfer at low temperatures undesirably. In order to prevent the badness in transfer, the amount of 12% by weight or less is preferable, and the amount of 11% by weight or less is more preferable.

When the amount of solid wax in the yellow hot-melt ink is more than 92% by weight, the amount of yellow pigment becomes less than 6% by weight, which results in undesirably lowering the printing density. Further, in order to make the content of the resin 3% by weight or more, it is preferable to use the solid wax in an amount of 91% by weight or less. When the amount of solid wax in the yellow hot-melt ink is less than 81% by weight, there easily brings about the badness in transfer at initial printing, particularly at low temperatures. In order to prevent the badness in transfer, the use of the solid wax in an amount of 82% by weight or more is preferable and in an amount of 83% by weight or more is more preferable.

If necessary, it is also possible to incorporate besides them antistatic agents and dispersants as additives.

The melting point of the yellow hot-melt ink produced by use of these materials is preferably 50° to 80° C., more preferably 65° C. to 75° C., from the viewpoint of shelf life and transferability, and its penetration is preferably 10 or less, more preferably 1 to 4 (JIS K2235, 25° C., 5 sec.) from the viewpoint of prevention of soiling. The quantity for application of the hot-melt ink is preferably 2 to 4 g/m$^2$ from the viewpoint of transferability and printing density.

In this invention, the contents of the solid wax and the resin of 81 to 92% by weight and 2 to 13% by weight, respectively, are only for the yellow hot-melt ink. In the case of the other colors, the contents of these materials need not necessarily be in the above ranges, and it is sufficient that these materials are blended by a conventional method according to the blending proportions for the yellow hot-melt ink.

As the substrate used in this invention, there can be used, for example, synthetic resin films such as polyester films, polyimide film; tissue paper such as condenser paper; etc. The thickness of the substrate is preferably about 4 to about 7 μm from the viewpoint of transferability. Usually, its surface to be brought into contact with a thermal head is provided with a heat-resistant layer to prevent sticking. The heat-resistant layer is formed by coating an acryl-silicone graft polymer onto said surface, followed by drying. When higher heat resistance is required, particles of alkoxysilane hydrolyzate, colloidal silica, etc. may be present together therewith.

The thickness of the heat-resistant layer is preferably made as small as possible so long as sticking-preventing effect can be obtained, and the quantity for application after drying is preferably 0.01 to 2 g/m$^2$.

It is sufficient that the heat-sensitive color transfer recording medium of this invention is produced by a conventional method, for example, application of the hot-melt inks onto the above-mentioned substrate by means of a coater such as a hot-melt coater, a solvent coater, or the like.

This invention is more concretely illustrated below by way of Examples and Comparative Examples.

In the following Examples and Comparative Examples, heat-sensitive color transfer recording media were evaluated as follows.

(1) Printing density

A thermal printer in which applied energy could freely be varied was used in order to facilitate evaluation of the thermal transferability of yellow hot-melt ink. Printing on an image-receiving sheet was conducted by means of said printer at an applied energy somewhat lower than that for a commercially available color thermal transfer printer, and the printing density of yellow color was measured.

As the thermal printer, a thermal printer MF-1 manufactured by Matsushita Electronic Components Co., Ltd. was used. As the printing conditions, the electric resistance of thermal head was 395 Ω, the applied voltage was 16.14V, and the pulse duration was 0.8 msec.

As the image-receiving sheet, there was used an image-receiving sheet TTR-PW (a trade name, mfd. by Mitsubishi Paper Mills, Ltd.) having a basis weight of 64 g/m$^2$.

The printing density was measured by means of a Macbeth densitometer RD-918 and rounded to one decinal. Evaluation by the naked eye was also carried out with the following marks:

⊙ very good
○ good
Δ slightly inferior
X poor (2) Evaluation of full color printing A color original was subjected to printing at an ambient temperature of 15° C. by means of a full color copy machine CX-5000 manufactured by Sharp Corp., and color image reproduced were rated with the naked eye as follows:

⊙ very good
○ good
Δ slightly inferior
X poor (3) Adherence of ink

Peeling of a yellow ink portion from the substrate of heat-sensitive color transfer recoridng medium was observed by crumpling the yellow hot-melt ink portion.

⊙ very good
○ good
Δ slightly inferior
X poor

Example 1

A yellow hot-melt ink was prepared so as to comprise 81% by weight of a solid wax, 13% by weight of a resin and 6% by weight of a yellow pigment.

As the solid wax, paraffin wax HNP-11 (a trade name, mfd. by Nippon Seiro Co., Ltd.) was used.

As the resin, an ethylene-vinyl acetate compolymer Evaflex 220 (a trade name, mfd. by Mitsui Polychemicals Co., Ltd.) was used.

As the yellow pigment, Chromophthal yellow was used.

A magenta hot-melt ink was prepared so as to comprise 81% by weight of a solid wax, 9% by weight of a resin and 10% by weight of a magenta pigment. The solid wax and the resin used therein were the same as those used in the yellow hot-melt ink. As the magenta pigment, Rhodamine Lake Y was used.

A cyan hot-melt ink was prepared so as to comprise 81% by weight of a solid wax, 9% by weight of a resin and 10% by weight of a cyan pigment. The solid wax and the resin used therein were the same as those used in the yellow hot-melt ink. As the cyan pigment, Phthalocyanine Blue was used.

A black hot-melt ink was prepared so as to comprise 79% by weight of a solid wax, 9% by weight of a resin and 12% by weight of a black pigment. The solid wax and the resin used therein were the same as those used in the yellow hot-melt ink. As the black pigment, carbon black was used.

The above-mentioned yellow, magenta, cyan and black hot-melt inks were applied onto a PET film of 6 μm in thickness having a heat-resistant layer on the side reverse to the heat-resistant layer side, each in an amount of 3 g/m$^2$ to obtain a heat-sensitive color transfer recording medium of this invention.

When printing was conducted according to the above evaluation method using the thermal printer manufactured by Matsushita Electronic Components Co., Ltd., the printing density of yellow color was 0.5. When printing was conducted according to the above evaluation method using the full color copy machine CX-5000 manufactured by Sharp Corp., clear color images could be obtained. The adherence of the inks was also good (i.e. no peeling took place).

Examples 2 to 7 and Comparative Examples 1 to 3

Heat-sensitive color transfer recording media were produced in the same manner as in Example 1, except that the mixing proportions of solid wax, resin and pigment in yellow hot-melt ink were varied as shown in Table 1.

In the same manner as in Example 1, the printing density and the full color printing were evaluated and the adherence of ink was tested.

The results obtained were as shown in Table 1.

TABLE 1

| | Example | | | | | | | Comparative Example | | |
|---|---|---|---|---|---|---|---|---|---|---|
| | 1 | 2 | 3 | 4 | 5 | 6 | 7 | 1 | 2 | 3 |
| Yellow hot-melt ink | | | | | | | | | | |
| Solid wax (wt %) | 81 | 82 | 83 | 85 | 89 | 91 | 92 | 69 | 80 | 93 |
| Resin (wt %) | 13 | 12 | 11 | 9 | 5 | 3 | 2 | 25 | 14 | 1 |
| Pigment (wt %) | 6 | 6 | 6 | 6 | 6 | 6 | 6 | 6 | 6 | 6 |
| Printing density | | | | | | | | X | Δ | |
| | 0.5 | 0.6 | 0.6 | 0.6 | 0.6 | 0.6 | 0.6 | 0.0 | 0.4 | 0.6 |
| Evaluation of full color printing | | | | | | | | X | Δ | |
| Adherence of inks | | | | | | | | | | X |

As is clear from Table 1, employment of the heat-sensitive color transfer recording medium of this invention makes it possible to prevent badness in transfer of a yellow color at initial printing, particularly at low temperature transfer.

Since a color thermal transfer printer using the heat-sensitive color transfer recording medium of this invention can give clear color images even at low temperatures, this invention has very remarkable practical effects.

What is claimed is:

1. A heat-sensitive color transfer recording medium comprising a substrate and hot-melt inks of a plurality of different colors including yellow in series applied onto one side of the substrate, the yellow hot-melt ink comprising 81 to 92% by weight of a solid wax, 2 to 13% by weight of a resin and 6 to 9% by weight of a yellow pigment said yellow hot-melt ink being used as a first color for printing.

2. A heat-sensitive color transfer recording medium according to claim 1, wherein the contents of the solid wax and the resin in the yellow hot-melt ink are 82 to 92% by weight and 2 to 12% by weight, respectively.

3. A heat-sensitive color transfer recording medium according to claim 1, wherein the contents of the solid wax and the resin in the yellow hot-melt ink are 83 to 91% by weight and 3 to 11% by weight, respectively.

4. A heat-sensitive color transfer recording medium according to claim 1, wherein said plurality of the different colors are yellow, magenta and cyan.

5. A heat-sensitive color transfer recording medium according to claim 1, wherein said plurality of the different colors are yellow, magenta, cyan and black.

6. A heat-sensitive color transfer recording medium according to claim 1, wherein the hot-melt inks are obtained by using a hot-melt coater.

7. In a process for printing a colored image on an image-receiving sheet by using a heat-sensitive color transfer recording medium, and transferring a yellow hot-melt ink first, followed by transferring other hot-melt inks, the improvement wherein the yellow hot-melt ink on the heat-sensitive color transfer recording medium comprises 81 to 92% by weight of a solid wax, 2 to 13% by weight of a resin and 6–9% by weight of a yellow pigment.

* * * * *